United States Patent [19]

Boisvert et al.

[11] 4,262,511

[45] Apr. 21, 1981

[54] PROCESS FOR AUTOMATICALLY CONTROLLING THE SHAPE OF SHEET METAL PRODUCED IN A ROLLING MILL

[75] Inventors: Jean Boisvert, Trois-Rivieres, Canada; Bobby J. Bond, Muscle Shoals, Ala.; Floyd B. McCoy, Jr., Richmond, Va.

[73] Assignee: Reycan Research Limited, Ontario, Canada

[21] Appl. No.: 940,651

[22] Filed: Sep. 8, 1978

[51] Int. Cl.[3] ..... B21B 37/04; B21B 27/06

[52] U.S. Cl. ..... 72/17; 72/34; 72/201

[58] Field of Search ..... 72/8, 9, 16, 10–12, 72/17

[56] References Cited

U.S. PATENT DOCUMENTS

| | | | |
|---|---|---|---|
| 3,078,747 | 2/1963 | Pearson | 72/9 |
| 3,081,651 | 3/1963 | Roberts | 72/9 |
| 3,307,215 | 3/1967 | Gerhard et al. | 18/2 |
| 3,334,508 | 8/1967 | Martin | 72/9 X |
| 3,499,306 | 3/1970 | Pearson | 72/17 |
| 3,534,571 | 10/1970 | Sivilotti et al. | 72/8 |
| 3,581,536 | 6/1971 | Terwilliger | 72/9 |
| 3,587,265 | 6/1971 | Sivilotti | 72/8 |
| 3,802,237 | 4/1974 | Albensi et al. | 72/17 |
| 3,921,425 | 11/1975 | Sendzimir | 72/10 X |

*Primary Examiner*—Milton S. Mehr

*Attorney, Agent, or Firm*—Schwartz, Jeffery, Schwaab, Mack, Blumenthal & Koch

[57] ABSTRACT

The invention relates to a process for automatically controlling the shape of sheet metal produced in a rolling mill, and to apparatus for carrying out the process. The shape of the sheet is sensed by a shapemeter, and each segment of the shapemeter provides an output indicative of the shape of the portion of the sheet passing over that segment. In accordance with the invention, the outputs are converted to electrical signal levels, such as current or voltage levels, and certain ones of the signal levels are averaged, and the averages are compared either with certain other signal levels, or with certain other averages. If the comparisons yield a difference greater than predetermined tolerance levels, control signals are generated to control parameters of the rolling mill.

5 Claims, 4 Drawing Figures

PROCESS FOR AUTOMATICALLY CONTROLLING THE SHAPE OF SHEET METAL PRODUCED IN A ROLLING MILL

BACKGROUND OF THE INVENTION

1. Field of the Invention

The invention relates to a process for controlling the shape of sheet metal produced in a rolling mill. More specifically, the invention relates to such a process which uses output signals from a shapemeter or a like device.

The invention also relates to an apparatus for implementing the process.

2. Statement of the Prior Art

As is known in the art, shape is defined as the cross sectional profile of a strip width of sheet metal with reference to a flat plane. A shapemeter is a device for measuring shape, and examples of such shapemeters are described in British Pat. No. 1,160,112 as well as the brochure of Davy-Loewy Limited, Loewy Robertson Division, entitled "Vidimon Shapemeter". The shapemeter is capable of detecting and displaying the degree and location of any out of flatness condition of a strip under tension which may, visually, appear to be flat.

Presently, the display of the shapemeter is monitored by a mill operator who applies appropriate control signals to correct the out of flat conditions. As will be appreciated, the operator can only initiate corrective action after the out of flat condition has existed for some time. Further, the reflex and speed limitations of human beings prevents corrective action from being immediately taken so that the out of flat condition will persist for some time after it is detected and displayed.

Teachings in the art which relate to controlling the shape of metal sheets produced in a rolling mill are exemplified by the following U.S. Pat. Nos.: 2,696,698; 3,064,509; 3,630,055; 3,686,907; 3,875,776; 3,882,709; 3,332,263; 3,514,984; 3,431,761; 3,475,935; 2,961,901; 3,213,665; 3,499,306 and 3,802,237.

Although it has been suggested that the output of the shapemeter be fed to a system for automatically initiating corrective action, applicant is not presently aware of the existence of a physical system for so doing.

SUMMARY OF THE INVENTION

It is therefore an object of the invention to provide a process for automatically controlling the shape of aluminum sheet produced in a rolling mill, and to provide an apparatus for carrying out the process.

In accordance with the invention, apparatus for controlling the shape of sheet metal produced in a rolling mill, said apparatus receiving a plurality of output signals from a sensor disposed across the width of said metal sheet, said sensor having a plurality of individual sensing means disposed at different locations across said width, a different one of said plurality of signals being associated with a different one of said individual sensing means comprises: averaging means; predetermined ones of said plurality of signals being fed to said averaging means, whereby the average of said predetermined ones of said plurality of signals is produced at the output of said averaging means; comparator means; the output of said averaging means being fed to one input terminal of said comparator means; predetermined other ones of said plurality of signals or other averages being fed to the other input terminal of said comparator means; the output of said comparator means being fed to means for controlling a parameter of said rolling mill; whereby, when said comparator means detects a difference, greater than a predetermined difference, between the inputs thereof, said parameter will be appropriately controlled.

BRIEF DESCRIPTION OF THE DRAWINGS

The invention will be better understood by an examination of the following description, together with the accompanying drawings, in which.

DETAILED DESCRIPTION OF THE DRAWINGS

Figure 1:
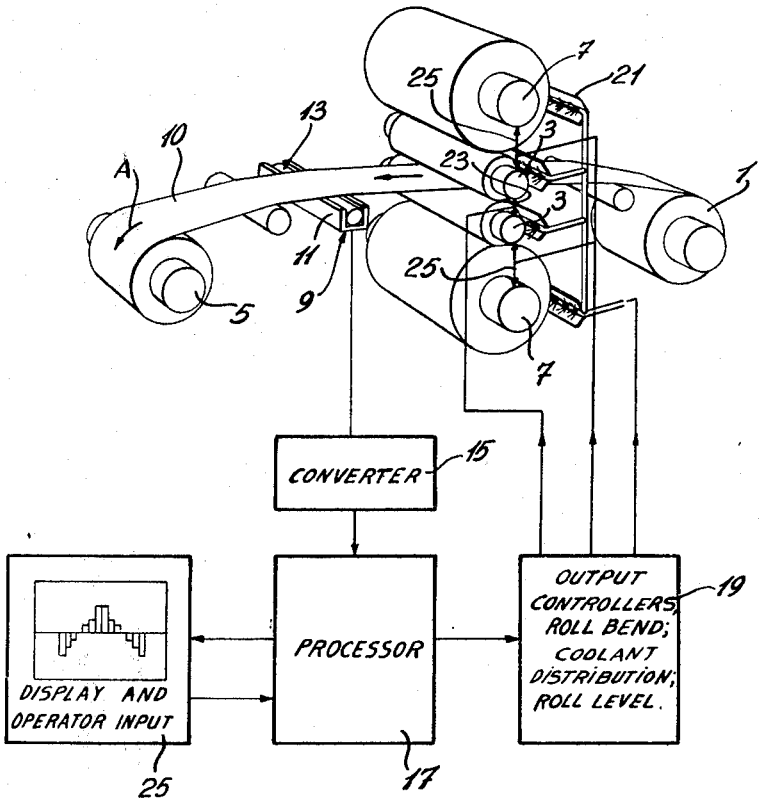
FIG. 1 is a block diagram of apparatus in accordance with the invention and for carrying out the inventive process.

Referring to FIG. 1, the rolling mill process is somewhat schematically represented by a roll of sheet metal 1, such as aluminum, drawn through shaping rolls 3 by driven roll 5 in the direction of the arrow A. Back up rolls 7 are also provided as well known in the art, and a shapemeter 9, for example, of the type described in British Pat. No. 1,160,112, the teachings of which are incorporated herein by reference, disposed across the width of the sheet 10, senses the shape of the sheet after it has passed through the shaping rolls.

As described in the British Patent, the shapemeter consists of a stationary arbor 11 and a segmented rotor 13 supported in the arbor by an air cushion and rotatable therein. This assembly produces pneumatic signals which, in the present application, are converted to electrical signals by converter 15, as well known in the art, as the apparatus in accordance with the invention comprises electronic apparatus.

The pneumatic signals are a function of the strip force applied to each rotor segment, and the pneumatic signals are converted to electrical levels, such as voltage levels or current levels, proportional to the level of the pneumatic signals.

The output of 15 is fed to processor 17, which could consist of discrete circuits as described below, or which could comprise a micro-processor with an appropriately programmed RAM.

The processor produces control signals fed to means for controlling the roll bend, means for controlling coolant distribution, and means for leveling the rolls. Although such means are illustrated in a single block 19 in FIG. 1, it will be appreciated that they are, in practice, separate means which are part of existing rolling mill systems, so that the control means, per se, do not constitute a part of the present invention.

The coolant distribution means comprise a series of sprays, schematically shown at 21 in FIG. 1, disposed across the width of the sheet 10. The means for controlling the roll bend are schematically illustrated by the arrows 23, and the means for leveling the rolls are schematically illustrated by the arrows 25. As above mentioned, these means are well known in the art, and it is therefore not necessary to describe them any further here.

The output of the processor is also applied to display means 25, which is preferably a CRT, as some of the control functions may be manually controlled rather than automatically. Thus, it is within the scope of the invention to provide a method and apparatus by which only roll bending and coolant distribution is automatically controlled, while roll leveling is operator controlled.

In accordance with the invention, certain ones of the signals from 9 are averaged, and the average thus obtained is compared with certain other ones of the signals or with averages of certain other ones of the signals, the result of the comparison constituting the control signals. The ones of the signals and the other ones of the signals could overlap, and, indeed, the ones and the other ones could constitute identical sets of signals. However, the average would be formed by all of the ones of the signals at the same time, and the average would then be compared to the other ones of the signals one at a time, as will be described below.

Figure 2:
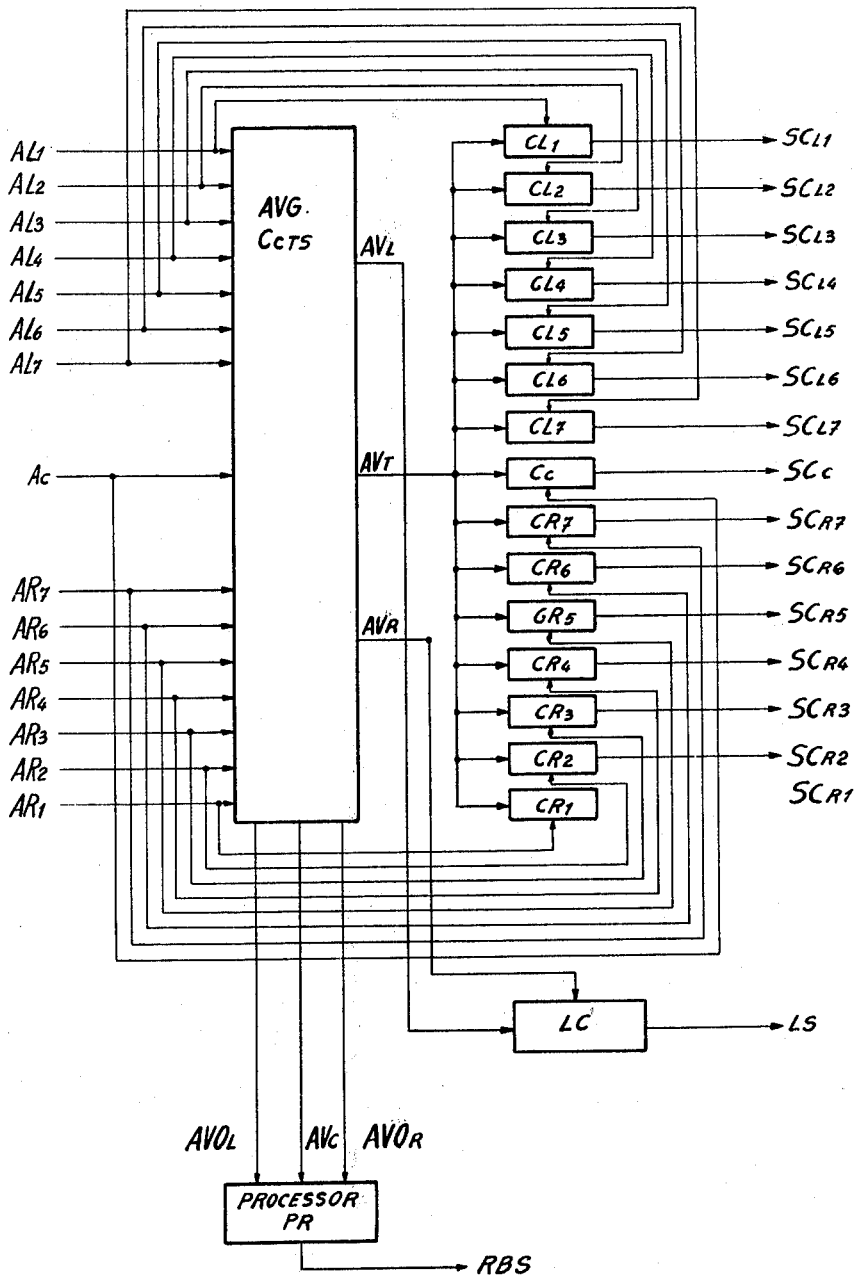
FIG. 2 illustrates an exemplary embodiment in greater detail than FIG. 1.
Figure 3:
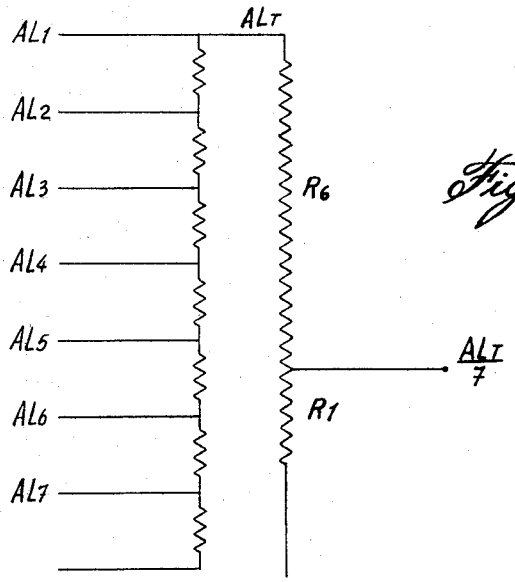
FIG. 3 is an exemplary embodiment of an analog averaging circuit.
Figure 4:
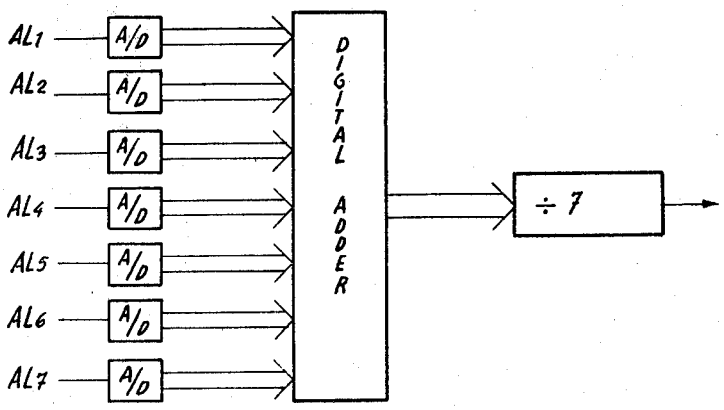
FIG. 4 is an exemplary embodiment of a digital averaging circuit.

Turning now to FIG. 2, there is illustrated, in block diagram form, a system which could perform the functions of the block 17 of FIG. 1. In FIG. 2, the designations $AL_1$ to $AL_7$ represent the signals from the rotors on the left hand side of the sheet, and the designations $AR_1$ to $AR_7$ represent the signals from the rotors on the right hand side of the sheet and the designation AC represents the signal from the central rotor, in a 15 segment shapemeter. These signals are fed to the averaging circuits which will provide averages as required and as described below. FIGS. 3 and 4 illustrate, respectively, an analog and a digital circuit for averaging. In FIG. 3, the ratio $R_1/R1+R6=1/7$, when there are 7 inputs being averaged. The circuits of FIGS. 3 and 4 are exemplary only, and the operation thereof is straight forward so that no further description thereof is required.

In considering now the process in accordance with the invention, as is known, it is desired to produce a sheet whose thickness is consistent throughout within stated tolerance limitations. However, portions having thicknesses above or below tolerance limitations will develop, and these portions will produce, respectively, greater or lesser pressures on their adjacent rotors and thereby be detected.

In order to increase or decrease the thickness of the sheet in such a portion, the output of its adjacent spray is either increased or decreased. Thus, coolant distribution is one parameter and controlling the coolant distribution is one function of the inventive process and apparatus.

In accordance with the invention, in order to correct such deviations in thickness, the outputs of all rotors are averaged, and the output of each rotor is then compared to this average one at a time.

Referring to FIG. 2, the signal $AV_T$ represents the average of all signals $AL_1$ to $AL_7$, AC and $AR_1$ to $AR_7$. $AV_T$ is applied at one input terminal of each of comparators $CL_1$ to $CL_7$, CC and $CR_1$ to $CR_7$. The other input terminal to these comparators is fed, respectively, $AL_1$ to $AL_7$, AC and $AR_1$ to $AR_7$. If the output of any of the comparators is greater, in the positive or negative directions, from a preset tolerance limit, then the spray adjacent the rotor from which the other input terminal to the respective comparator is fed is appropriately controlled to either increase or decrease its output. The spray will continue at this changed level until the output of the respective comparator falls within the tolerance limits, whereupon it will resume its normal level.

To determine whether it is necessary to level the shaping rolls, two averages are required—the average of all signals from the rotors on the left hand side of the sheet, $AV_L$— and the average of all signals from the rotors on the right hand side of the sheet, $AV_R$. If the average on the right hand side is greater than the average on the left hand side, this means that more pressure is being exerted on the right hand rotors than on the left hand rotors, i.e., the right hand side of the roll is closer to the sheet than the left hand side of the roll. The roll must thus be releveled to tilt the right hand side upward (away from the sheet), and the left hand side downward (towards the roll). $AV_L$ and $AV_R$ are compared in comparator LC, and if the output of this comparator exceeds tolerance limits, the leveling mechanism is actuated to relevel the roll. As above mentioned, the function controlling this second parameter can be performed automatically, or it can be operator controlled.

The cross-sectional shape of the sheet, or mill roll flexture, is a function of the material being shaped as well as the requirements of the particular mill, and this parameter must also be monitored. To perform this monitoring function, an average is taken of signals from a proportion of the outside segments on the right hand side of the sheet—$AVO_R$, a second average is taken of signals from a proportion of the outside segments on the left hand side of the sheet—$AVO_L$, and a third average is taken from a proportion of segments at the center of the sheet—$AV_C$. In one embodiment, the proportions are 25%, 25% and 50%. Thus, in the illustrated embodiment, $AV_L$ is formed from signals $AL_1$ to $AL_4$, $AV_R$ is formed from signals $AR_1$ to $AR_4$, and $AV_C$ is formed from signals $A_C$, $AL_1$, $AL_2$, $AR_1$ and $AR_2$.

The averages so formed are fed to the processor PR in FIG. 2 which has, stored in its memory, the required averages for the desired shape. Any deviations beyond tolerance from the required averages will provide a control signal to the roll bending mechanism to bend the roll so as to produce a sheet of the required shape.

With automatic detection and control, detection of deviations and controls to correct them are almost instantaneous. Regardless of the experience of an operator, his speed of response can never even approximate the speed of electronic response, so that shape of the sheet will be improved due to automatic control. However, the human element can never be fully programmed into a machine, so that overrides should be provided to allow the operator to include the human element and experience in the process.

In the above description, we have assumed a shapemeter having fifteen rotors. As is known, the same mill may be used to shape wider or narrower sheets. To accommodate all widths of sheets, the sheet is centered on the sensor, and any unused rotors on both ends thereof are turned off, as well known in the art. Of course, shapemeters with different numbers of rotors can also be used.

Although several embodiments have been described, this was for the purpose of illustrating, but not limiting, the invention. Various modifications, which will come readily to the mind of one skilled in the art, are within the scope of the invention as defined in the appended claims.

We claim:

1. Apparatus for controlling the shape of sheet metal produced in a rolling mill, said apparatus receiving a plurality of output signals from a sensor disposed across the width of said metal sheet, said sensor having a plurality of individual sensing means disposed at different locations across said width, a different one of said plurality of signals being associated with a different one of said individual sending means;

said apparatus comprising:

averaging means;

predetermined ones of said plurality of signals being fed to said averaging means, whereby the average of said predetermined ones of said plurality of signals is produced at the output of said averaging means;

first comparator means;

the output of said averaging means being fed to one input terminal of said first comparator means;

predetermined other ones of said plurality of signals or other averages being fed to the other input terminal of said first comparator means;

the output of said first comparator means being fed to means for controlling a parameter of said rolling mill;

whereby, when said first comparator means detects a difference, greater than a predetermined difference, between the inputs thereof, said parameter will be appropriately controlled;

said sensor comprising a shapemeter having a plurality of segments, a different one of said segments of said shapemeter being associated with a different one of said plurality of signals;

said plurality of signals comprising electrical signal levels;

said averaging means comprising electronic averaging means;

said first comparator means comprising electronic comparator means;

said averaging means comprising two averagers;

the signals from the segments on the right hand side of the sheet being fed to one of said averagers;

the signals from the segments on the left hand side of the sheet being fed to the other averager;

the output of said one averager being fed to one input terminal of said first comparator means;

the output of said other averager being fed to another input terminal of said first comparator means;

the output of said first comparator means being fed to a roll level controller;

whereby when the inputs to the first comparator means comprises a difference of or greater than a predetermined amount, the level controller will control the roll level means to operate to eliminate the difference.

2. Apparatus for controlling the shape of sheet metal produced in a rolling mill, said apparatus receiving a plurality of output signals from a sensor disposed across the width of said metal sheet, said sensor having a plurality of individual sensing means disposed at different locations across said width, a different one of said plurality of signals being associated with a different one of said individual sensing means;

said apparatus comprising:

averaging means;

predetermined ones of said plurality of signals being fed to said averaging means, whereby the average of said predetermined ones of said plurality of signals is produced at the output of said averaging means;

first comparator means;

the output of said averaging means being fed to one input terminal of said first comparator means;

predetermined other ones of said plurality of signals or other averages being fed to the other input terminal of said first comparator means;

the output of said first comparator means being fed to means for controlling a parameter of said rolling mill;

whereby, when said first comparator means detects a difference, greater than a predetermined difference, between the inputs thereof, said parameter will be appropriately controlled;

said sensor comprising a shapemeter having a plurality of segments, a different one of said segments of said shapemeter being associated with a different one of said plurality of signals;

said plurality of signals comprising electrical signal levels;

said averaging means comprising electronic averaging means;

said first comparator means comprising electronic comparator means;

said averaging means comprising first, second and third averagers;

and wherein said first comparator means comprises a processor;

a first portion of said plurality of signals, derived from a first portion of segments on the outer right hand side of said sheet being fed to said first averager;

a second portion of said plurality of signals derived from a second portion of segments on the outer left hand side of said sheet being fed to said second averager;

a third portion of said plurality of signals, derived from the central segments, being fed to said third averager;

the outputs of said averagers being fed to respective input terminals of said processor which has, stored in memory, required respective averages;

whereby when the outputs of said averagers differ from said required averages by an amount equal to or greater than a predetermined amount, the roll bend means are controlled to bend the roll back to reduce the differences.

3. Apparatus as defined in claim 2 wherein said first portion of segments comprises the 25% of the segments disposed on the outer right hand side of said sheet;

and wherein said second portion of segments comprises the 25% of the segments disposed on the outer left hand side of said sheet;

and wherein said third portion comprises the 50% of the segments disposed centrally of said sheet.

4. Apparatus as defined in claim 1 and further comprising:

a third averager;

all of said plurality of signals being fed to said third averager whereby the output of said third averager is the average of all of said plurality of signals;

second comparator means comprising a plurality of comparators equal to the plurality of signals;

the output of said third averager being fed to one input terminal of each of said plurality of comparators;

a different one of said plurality of signals being fed to the second input terminal of a respective one of said plurality of comparators;

the output of each comparator being fed to a spray control means, each spray control means being associated with a separate spray means, each spray means being disposed in a position across the width of said roll corresponding, respectively, with the position of the segment which provides the signal feed to its respective comparator, each spray means being adapted to operate at a predetermined normal level output;

whereby when a signal has a difference from the average equal to or greater than a predetermined amount, the spray associated with the segment from which the signal is provided will be controlled to operate in a manner to increase or decrease the spray output from the normal level.

5. Apparatus as defined in claim 2 and further comprising:

fourth averaging means;

all of said plurality of signals being fed to said fourth averaging means whereby the output of said fourth averaging means is the average of all said plurality of signals;

second comparator means comprising a plurality of comparators equal to the plurality of signals;

the output of said fourth averaging means being fed to one input terminal of each of said plurality of comparators;

a different one of said plurality of signals being fed to the second input terminal of a respective one of said plurality of comparators;

the output of each comparator being fed to a spray control means, each spray control means being associated with a separate spray means, each spray means being disposed in a position across the width of said roll corresponding, respectively, with the position of the segment which provides the signal feed to its respective comparator, each spray means being adapted to operate at a predetermined normal level output;

whereby, when a signal has a difference from the average equal to or greater than a predetermined amount, the spray associated with the segment from which the signal is provided will be controlled to operate in a manner to increase or decrease the spray output from the normal level.

* * * * *